United States Patent [19]

Buske

[11] 3,987,767

[45] Oct. 26, 1976

[54] EXPANSIBLE CHAMBER DEVICE

[75] Inventor: Norman L. Buske, Saunderstown, R.I.

[73] Assignee: Quadratics Inc., Wickford, R.I.

[22] Filed: Feb. 15, 1974

[21] Appl. No.: 443,121

[52] U.S. Cl. ..... 123/51 R; 92/69 R; 92/89; 123/51 B; 60/517; 60/519

[51] Int. Cl.[2] ..... F02B 25/08

[58] Field of Search ..... 92/69, 75, 89; 123/51 R, 51 A, 51 B

[56] References Cited

UNITED STATES PATENTS

| | | | |
|---|---|---|---|
| 696,768 | 4/1902 | Sleeper | 92/89 X |
| 722,259 | 3/1903 | Sleeper | 92/89 |
| 2,127,758 | 8/1938 | Schmitz | 92/69 A X |
| 2,507,923 | 5/1950 | Morris | 92/69 R X |
| 3,134,372 | 5/1964 | Braun | 123/51 B X |
| 3,315,653 | 4/1967 | Chicurel | 123/51 B X |
| 3,692,005 | 9/1972 | Buske | 92/69 R X |

*Primary Examiner*—Martin P. Schwadron
*Assistant Examiner*—Abraham Hershkovitz
*Attorney, Agent, or Firm*—Robert E. Burns; Emmanuel J. Lobato; Bruce L. Adams

[57] ABSTRACT

An internal pressure engine comprises at least three like members called hedrons movable between two parallel end plates. Each of the hedrons has opposite end faces engaging the end plates, an inner face extending between the end faces and a sealing face disposed relative to the inner face at an angle equal to 360° divided by the number of hedrons. The sealing face of each hedron engages the inner face of the next adjacent hedron so as to form a working chamber bounded by the end plates and the inner faces of the hedrons. The hedrons are supported and guided for translatory movement along rectilinear paths to vary the volume of the working chamber while maintaining the sealing faces of the hedrons in engagement with the inner faces of adjacent hedrons. Movement of the hedrons is synchronized by means of an oscillating member which is pivotally connected with each of the hedrons. Oscillatory movement of the synchronizing member is converted into rotary movement of a drive shaft by a crank mechanism. When operated as a two stroke cycle internal combustion engine, valving is provided by movement of the hedrons and a fuel injector is provided for injecting fuel into the working chamber at approximately minimum volume.

28 Claims, 22 Drawing Figures

FIG. 12
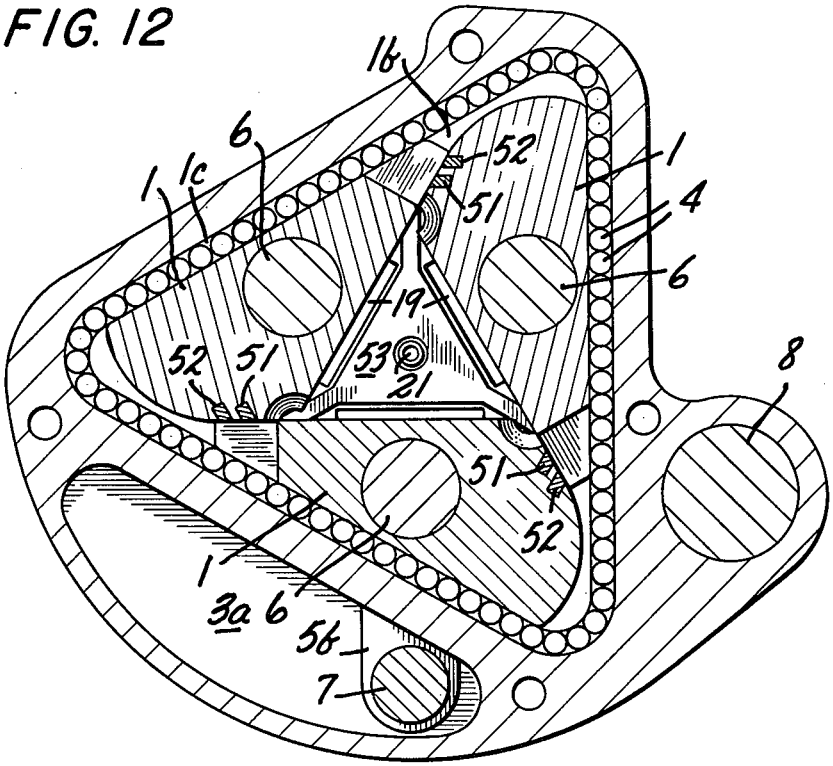
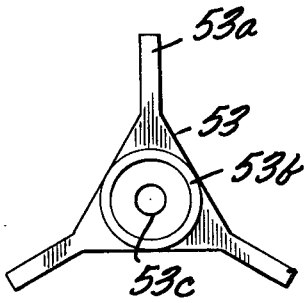
FIG. 13

EXPANSIBLE CHAMBER DEVICE

The present invention relates to an internal pressure engine having at least one expansible chamber defined by at least three members called hedrons movable between spaced parallel end plates. The volume of the chamber is varied periodically by the coordinated movement of the hedrons while maintaining sealing contact of the hedrons with one another and with the end plates. The term "engine" is herein used in a broad sense to include internal or external combustion engines, pumps, compressors, expanders and other expansible chamber devices. While herein described with particular reference to internal and external combustion engines, the invention is also applicable to other uses where an expansible chamber is required.

In the type of internal combustion engine which is at present most commonly used, one or more combustion chambers are provided by pistons reciprocating in stationary cylinders. The pistons are connected by connecting rods to a rotatable crank shaft. The reciprocation of the pistons, rotation of the crank shaft and complex movement of the connecting rods give rise to vibratory forces which are difficult to counteract. Moreover, it is necessary to provide special sealing means, for example piston rings, between the pistons and the walls of the cylinder in an effort to contain the combustion products of the fuel burned in the cylinder. Imperfect sealing results in "blow-by" which not only decreases the power and efficiency of the engine but also gives rise to serious air pollution. Efforts have been made in recent years to decrease air pollution but these have for the most part resulted in lower efficiency, increased fuel consumption and higher manufacturing and operating expense.

Various rotary engines have been proposed from time to time but except for decreased vibration, they have not been found to overcome the problems which beset reciprocating engines. Moreover, they have been found to involve sealing, lubrication, cooling and other problems which have proved difficult to solve.

It is an object of the present invention to provide a new type of engine having important advantages over those heretofore known. In accordance with the invention, one or more expansible combustion chambers are provided by at least three cooperating members called hedrons which are movable relative to one another between spaced parallel end plates. Each of the hedrons has an inner face defining one side of the combustion chamber and a sealing face disposed at an angle to the inner face and engageable with the inner face of the next adjacent hedron to provide a seal in all positions of the hedron. The hedrons are movable cyclically inwardly and outwardly respectively to decrease and increase the volume of the combustion chamber. Movement of the hedrons relative to one another is synchronized by means of an oscillating member which is connected with each of the hedrons. Oscillatory movement of the synchronizing member is converted to rotary movement which is transmitted to a drive shaft. Thus, rotary movement of the drive shaft is produced by the cyclical inward and outward movement of the hedrons.

The novel principles of the present invention are particularly applicable to a two-stroke fuel injection internal combustion engine, for example an engine operating on the Diesel cycle. However, the invention is also applicable to four-stroke cycle internal combustion engines and to external combustion engines, for example those operating on the Stirling cycle. As applied to internal combustion engines, the invention has the following features and advantages:

1. HIGHER EFFICIENCY: In normal (part throttle) operation, Diesel engines have higher efficiency than spark-ignition engines because of higher compression ratio and because of elimination of throttling losses. Operating efficiency (miles/gallons) of automobiles is also affected by the time available for combustion, heat losses, mechanical efficiency and unit weight. An engine in accordance with the present invention is somewhat more efficient than conventional Diesel engines. Gas mileage is 50 to 100 percent greater than with conventional spark-ignition automative engines. Moreover, improved mechanical efficiency results from short stroke operation combined with moderate peak torque, low pressure forces, a dry sealing system and the elimination of complex valving assemblies.

2. GREATER POWER OUTPUT: Engines in accordance with the present invention have short strokes which permit high speed operation with high specific power output. Consequently, they are relatively small and light particularly in comparison with conventional Diesel engines.

3. LOWER COOLING REQUIREMENTS: Cooling requirements are nearly halved because of the low surface area of the combustion chamber. Cooling is accomplished by the combined effects of unthrottled induction air flow and convective or conductive cooling of or for the housing including the end plates which partially confine the combustion chamber.

4. IMPROVED PORTING: An engine in accordance with the invention operates on a two-stroke cycle with a low pressure air blower and precompression of the induction air in the housing by hedron movement. Valving is accomplished by hedron motions. No complex valving system is required.

5. REDUCED LOADING: Peak working pressure force is reduced because of the small surface area of the chamber near minimum volume. Inertial forces are reduced by the short stroke operation. This permits high speed operation for similar inertial forces.

6. IMPROVED LUBRICATION: As the hedrons are contained in a dry or nearly dry housing, engine oil consumption and the associated hydrocarbon emissions are virtually eliminated. While the crankcase contains lubricant, oil seals prevent ingress of lubricant into the hedron housing. Temperatures in the sealing areas are low to moderate.

7. IMPROVED SEALING: In a typical construction in accordance with the invention each hedron has one or two end seals and one or two tip seals. These seals are strips which operate dry. Sealing lengths are reduced without sacrificing the area available for porting. The relatively large porting area permits high speed operation despite a relatively short dwell time at maximum volume.

8. REDUCED FRICTION LOSSES: Improved mechanical efficiency results from short stroke operation combined with moderate peak torque, low pressure forces, a dry sealing system and the elimination of complex valving assemblies.

9. IMPROVED BALANCE: An engine in accordance with the present invention is inherently balanced because movement of the hedrons is symmetrical.

Small imbalances in the synchronizing and drive mechanism are compensated in multichamber units.

Engines in accordance with the present invention thus provide a potential solution to the problem of obtaining low emission pollution without sacrificing efficiency as in conventional internal combustion engines. Moreover, engines in accordance with the invention are compact and lightweight and thereby contribute to the possibility of increasing performance and fuel mileage through decrease in the weight of the vehicle.

As applied to external combustion engines such as those operating on the Stirling cycle, the invention affords the advantages enumerated above and moreover makes possible better matching of the compression and expansion volumes than is obtainable with conventional reciprocating engines. The invention is thus particularly applicable to Stirling engines.

The objects, characteristics and advantages of the invention will be more fully understood from the following description of preferred embodiments shown schematically and by way of example in the accompanying drawings in which:

FIG. 12 is a midplane section similar to FIG. 2 but showing a different sealing arrangement;

FIG. 13 is an end view of an end plate seal;

Figure 1:
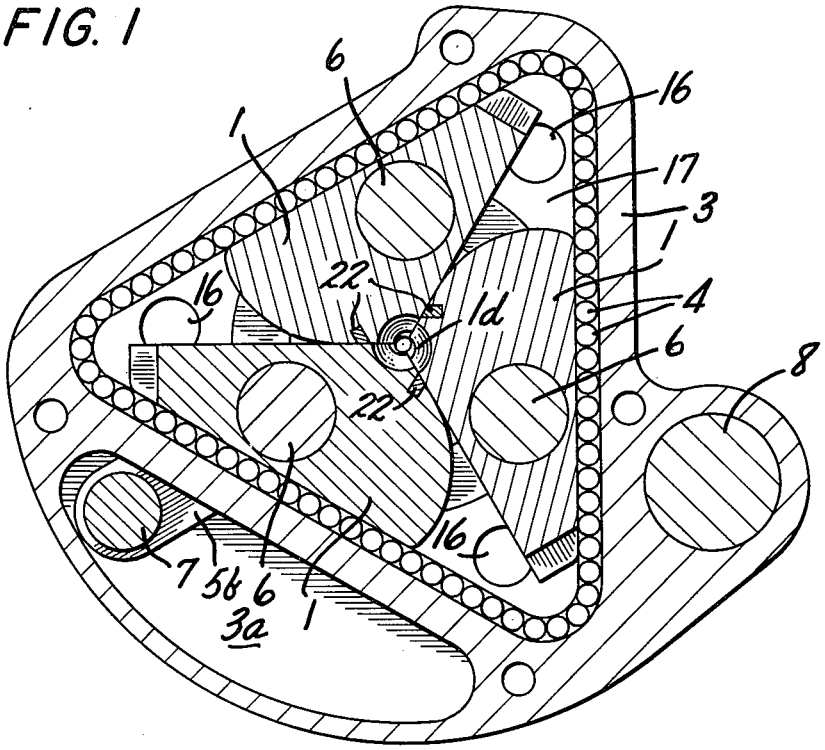
FIG. 1 is a midplane section of an expansion combustion chamber in accordance with the invention, the hedrons shown in inner position in which they have moved somewhat passed the position of minimum volume of the combustion chamber.

An internal combustion engine in accordance with the present invention as illustrated by way of example in FIGS. 1 to 5 comprises a plurality of identical hedrons 1 disposed between opposite parallel end plates 2 of a housing or casing 3. The number of hedrons is preferably three as illustrated in the drawings. While a larger number of hedrons can theoretically be used, this results in a larger number of parts and greater complexity without commensurate advantages. From an engineering and economic point of view, it is undesirable to use more than six hedrons.

Each of the hedrons has opposite end faces engaging respectively the opposite end plates 2, inner faces 1*a* defining a working chamber C, sealing faces 1*b* engageable respectively with inner faces of the adjacent hedrons and outer faces 1*c*. With three hedrons as shown, the sealing face 1*b* is disposed at an angle of 120° to the inner face 1*a* while the outer face 1*c* is disposed at an angle of 30° to the inner face.

Figure 2:
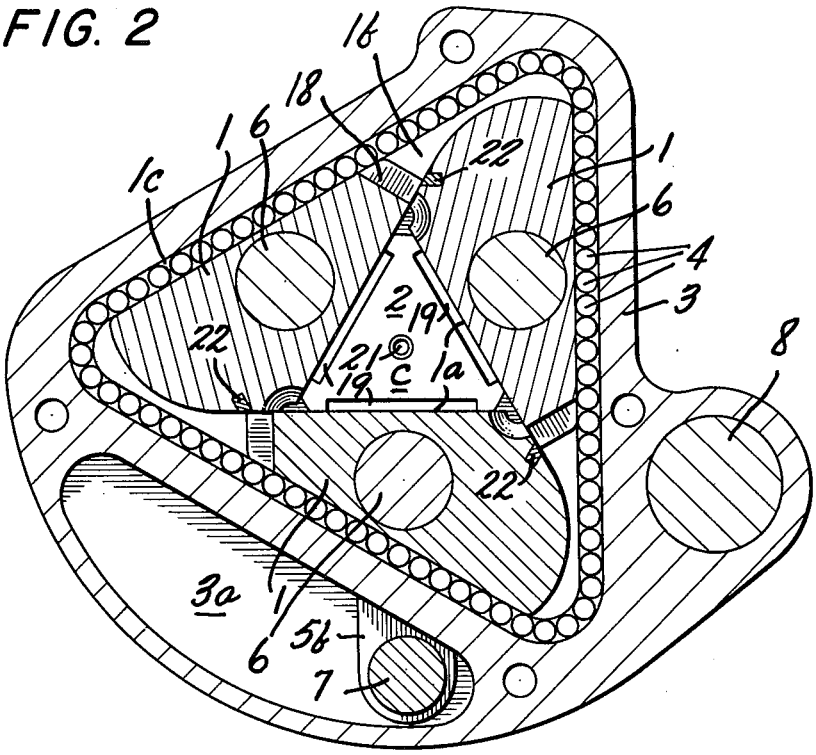
FIG. 2 is a midplane section similar to FIG. 1 but showing the hedrons in outer position with the combustion chamber at approximately maximum volume.

The hedrons are supported and guided in the housing for movement between an inner position as illustrated in FIG. 1 and an outer position as illustrated in FIG. 2. As illustrated by way of example in FIGS. 1 and 2, the hedrons are guided and supported by roller bearings 4 disposed between the outer faces of the hedrons and peripheral wall portions of the housing. It will be seen that the movement of each of the hedrons is translatory and rectilinear. When the hedrons are in their outer positions as illustrated in FIG. 2, the working chamber C is of maximum volume. When the inner faces of the hedrons intersect at a point, the volume of the working chamber C is reduced to zero except for a diconic combustion chamber formed by recesses 1*d* provided at the inner apices of the hedrons. In the position shown in FIG. 1, the hedrons have moved inwardly slightly beyond the zero volume position so that the recesses 1*d* do not exactly match with one another.

Figure 3:
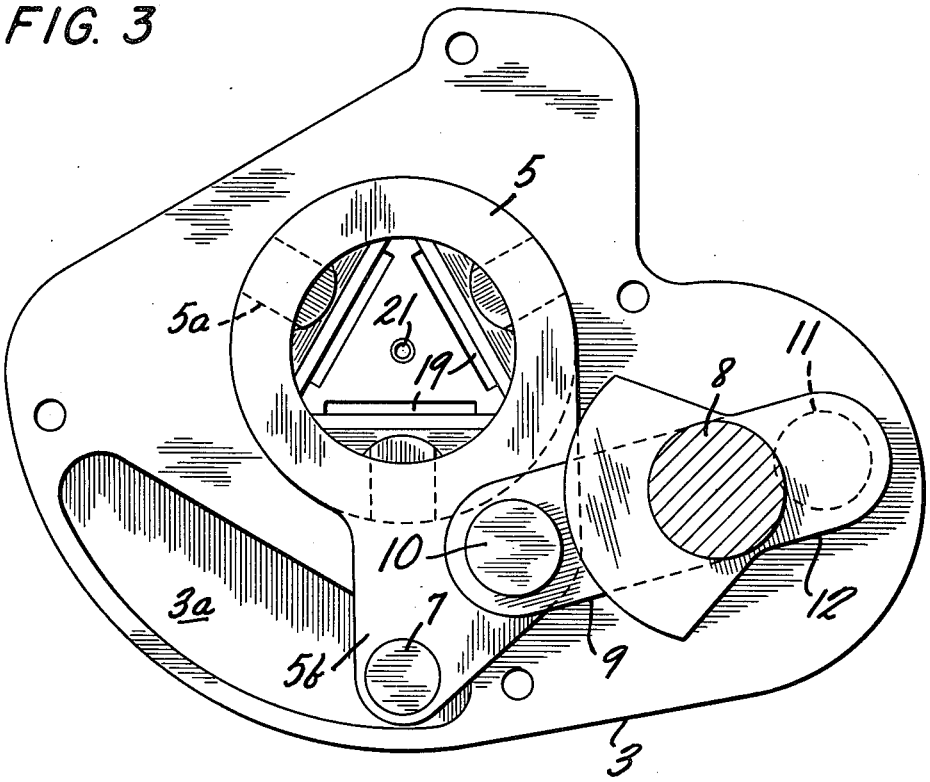
FIG. 3 is an end view with the crankcase cover removed to show the synchronizing and drive mechanism.
Figure 4:
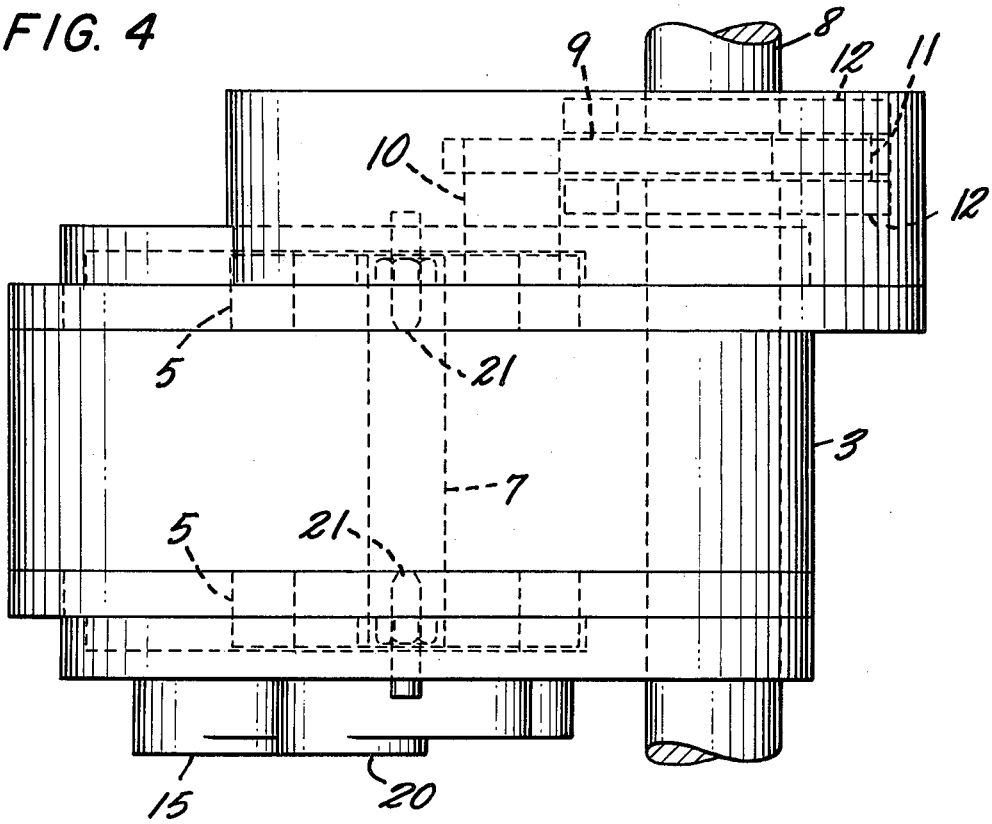
FIG. 4 is a side view of the single chamber unit shown in FIGS. 1, 2 and 3.

Means is provided for synchronizing the movement of the hedrons with one another and for transmitting movement of the hedrons to a power output. The synchronizing means is illustrated in FIGS. 1, 2 and 3 as comprising rings 5 disposed at opposite ends of the hedrons. On its inner face each of the synchronizing rings 5 has bosses 5*a* slidably engaging in diametrical slots 6*a* provided in opposite ends of pins 6 which are rotatable in holes extending through the hedrons perpendicular to the end faces. As seen in FIGS. 5A and 5C, the hedrons are provided with cut-out portions 1*e* to accommodate the bosses 5*a* of the synchronizing rings 5. The two synchronizing rings 5 at opposite ends of the hedrons are connected with one another by a tie rod 7 extending between radially outwardly projecting arm portions 5*b* of the rings. As the hedrons move in and out, the synchronizing rings 5 move angularly between the positions illustrated respectively in FIGS. 1 and 2. By reason of the tie rod 7, the two synchronizing rings move in unison with one another. Movement of the tie rod is accommodated by an arcuate opening 3*a* in the housing 3. By reason of their connection with the synchronizing rings 5, the hedrons move inwardly and outwardly in unison with one another. Cyclical reciprocatory movement of the hedrons is converted into oscillatory angular movement of the synchronizing rings.

In the embodiment illustrated in FIGS. 1 to 5, oscillatory movement of the synchronizing rings 5 is converted into rotary movement of a shaft 8. At least one of the synchronizing rings 5 is connected with the shaft 8 by means of a connecting rod 9 extending between a wrist pin 10 carried by th synchronizing ring 5 and a crank pin 11 extending between opposite cheeks of a crank 12 on the shaft 8. The crank is statically and dynamically balanced by sector shaped counterweights 13 on the shaft. With the construction shown, reciprocatory movement of the hedrons between the positions shown in FIGS. 1 and 2 produces oscillatory angular movement of the synchronizing rings 5 which in turn is converted into rotary movement of the crank shaft 8.

The engine illustrated in FIGS. 1 to 4 is shown as operating on a two stroke Diesel cycle. Air is supplied by an intake manifold 15 which is connected by three intake passages 16 with precompression chambers 17 which are formed between the hedrons and the outer peripheral wall of the housing 3. By a comparison of FIG. 1 with FIG. 2, it will be seen that as the hedrons move outwardly, the volume of the precompression chambers 17 is reduced. Air drawn into the precompression chambers 17 through the intake passages 16 as the hedrons move inwardly (FIG. 1) is compressed when the hedrons move outwardly to the position shown in FIG. 2. The intake passages 16 are provided with check valves to prevent reverse flow of the intake air. Moreover, air to the intake manifold may be supplied by a blower or supercharger. However, by reason of compression of the air in the precompression chambers 17, high pressure supercharging is not required.

When the hedrons move outwardly to the position shown in FIG. 2, the air which has been precompressed in chambers 17 is admitted to the working chamber C through transfer ports 18 which in this position of the hedrons communicate with the recesses 1*d* forming the diconic combustion chamber. The transfer ports 18 are formed as recesses in the tips of the hedrons defined by the intersection of the inner and outer faces. The admission of precompressed air to the working chamber C purges the chamber of combustion products from the previous power stroke which are exhaused through exhaust ports 19 communicating with an exhaust manifold 20. The exhaust ports are uncovered when the hedrons are in their outer positions as shown in FIG. 2. Since both the exhaust ports and the transfer ports are opened and closed by movement of the hedrons, no valving or valve operating mechanism is required.

Fuel is supplied by fuel injectors 21 which are located centrally in the end plates 2. The injectors comprise nozzles which direct the fuel into the diconic combustion chamber formed by the recesses 1*d.* As customary in Diesel engines, the fuel is ignited by reason of the high temperature to which the gas in the working chamber is raised by compression. Alternatively, ignition can be obtained by means of a glow plug or spark plug which replaces on of the fuel injectors 21. Fuel is supplied to the injectors by suitable pressure pump means operated in synchronism with the movement of the hedrons so that the fuel is injected at the proper time. By reason of the geometry of the engine, a relatively long period of time is available for complete combustion of the fuel thereby eliminating or reducing unburned hydrocarbon emissions. A further factor contributing to avoiding unburned hydrocarbon emissions is the low surface to volume ratio of the combustion chamber and hence reduced "quench" of the burning fuel. The low surface area of the combustion chamber also reduces cooling requirements of the engine. It will be seen that the hedrons are cooled by the intake air which is admitted behind the hedrons before entering the working chamber. Coolant may also be transferred to and from the hedrons from the peripheral wall portions or end plate portions of the housing.

Provision is made for a fluid tight sealing engagement of the hedrons with one another and with the end plates. A seal between the hedrons is provided by a sealing strip 22 set in a corresponding groove 23 in the sealing face of each hedron in position to engage the inner face of the adjacent hedron. The sealing strip 22 is preferably of a material that does not require lubrication and is spring pressed, for example by a wavy spring between the sealing strip and the bottom of the groove 23 (FIGS. 5A, 5B and 5D) is which it is fitted. The sealing strips 22 extend from one end plate to the other.

Figure 5B:
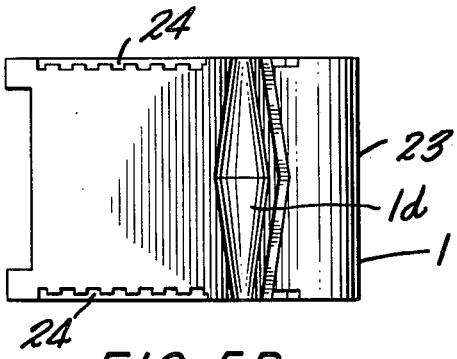
FIGS. 5A–5D are projected views of a single hedron.
Figure 5A:
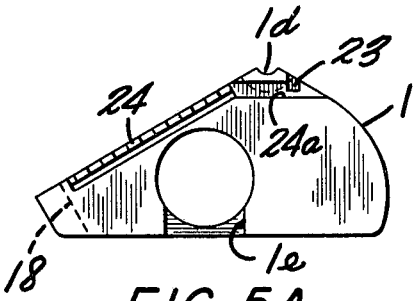
Figure 5D:
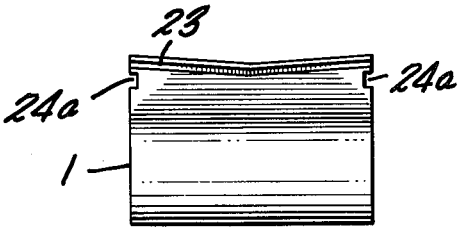
Figure 5C:
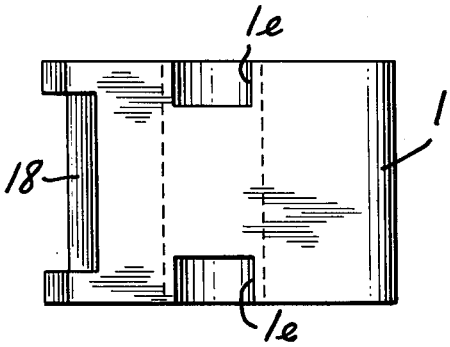
Figure 6A:
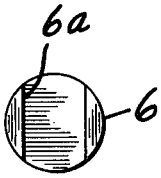
FIGS. 6A and 6B are respectively an end view and side view of a hedron pin providing a sliding pivotal connection between a hedron and a synchronizing member.
Figure 6B:
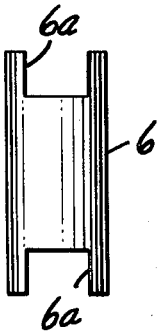

A seal between the hedrons and the end plates is provided by sealing strips set into recesses 24 provided in the end faces of the hedrons adjacent the sealing faces (FIGS. 5A and 5B). Each of the recesses has an angularly disposed portion 24*a* which extends to the groove 23 for the sealing strip between the hedrons. The end sealing strips are preferably also of a material not requiring lubrication and are resiliently urged against the end plates. As seen in FIGS. 5A and 5B, the recesses are provided with square teeth for holding the sealing strips in place. Moreover, the sealing strips are held in their recesses by the positive pressure which at all times prevails in the working chamber. As the end sealing strips as well as the edge sealing strips are straight and as the motion between the parts to be sealed is rectilinear, the sealing of the engine is relatively simple.

Figure 7:
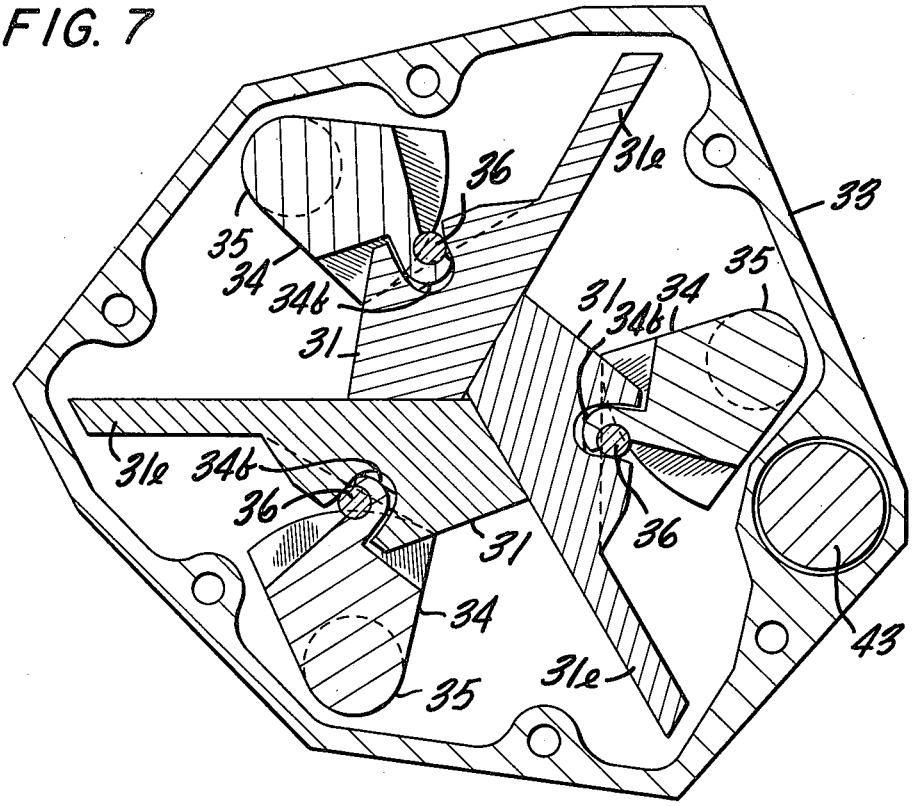
FIGS. 7 and 8 are views similar to FIGS. 1 and 2 but showing another embodiment.
Figure 8:
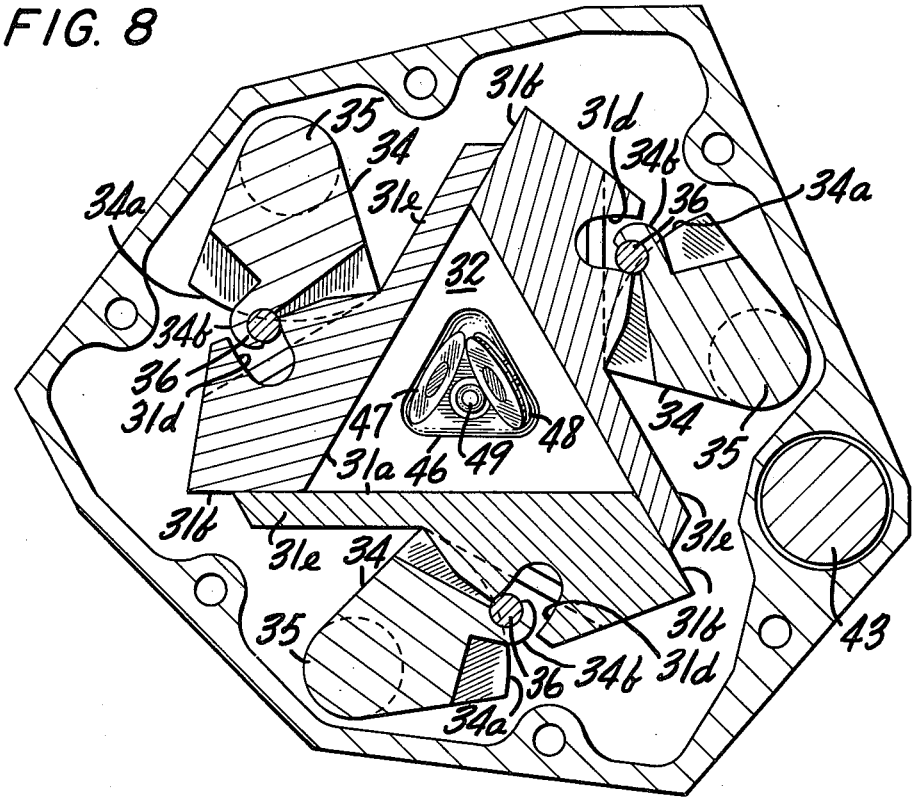
Figure 9:
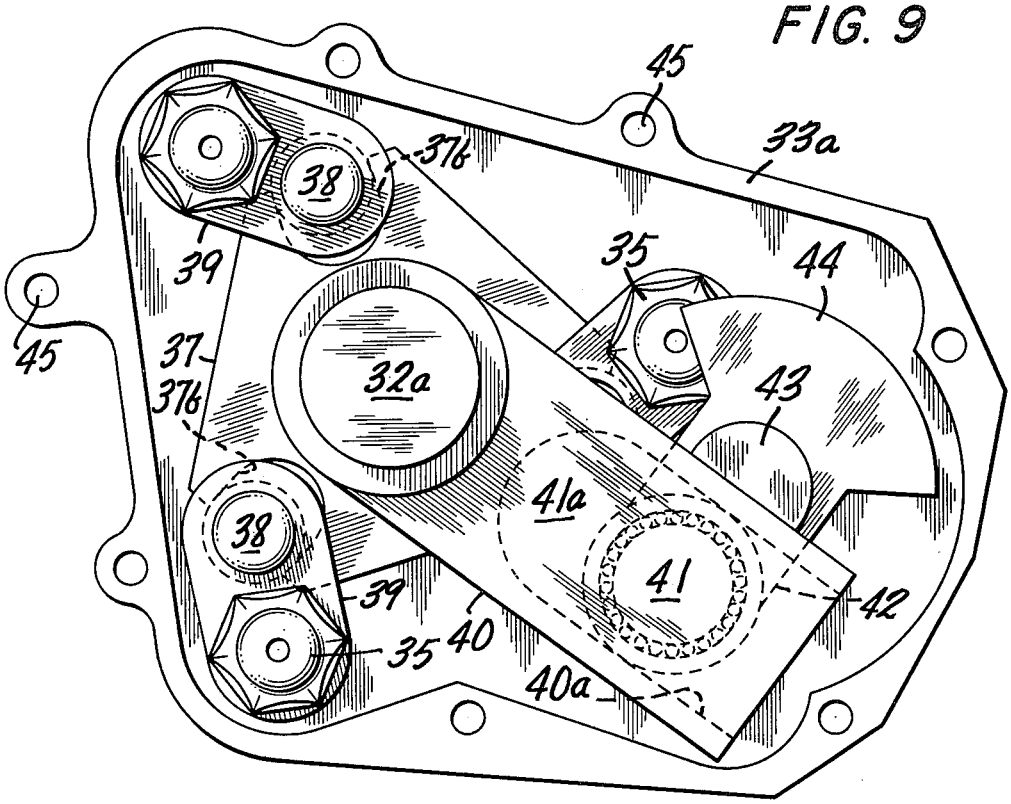
FIG. 9 is an end view of the embodiment shown in FIGS. 7 and 8 with the crankcase cover removed to show the synchronizing and drive mechanism.

A second embodiment of the invention is illustrated by way of example in FIGS. 7 to 9 as an internal combustion engine operating on a four stroke cycle with spark ignition. The engine is shown as comprising three hedrons 31 movable between spaced parallel end plates 32 in a housing 33. The hedrons have end faces abutting the end plate, inner faces 31*a* defining a working chamber C and sealing faces 31*b* engaging the inner faces of adjacent hedrons to form a seal. An outer face of each hedron is formed to provide parallel bearing surfaces 1*c* adjacent the end faces while an intermediate portion of the outer face is provided with a notch 31*d.* When there are three hedrons as shown, the sealing face 31*b* is disposed at an angle of 120° from the inner face 31*a.* The bearing surfaces 31*c* are disposed at an angle of 30° to the inner face. Each of the hedrons is further provided with an extension 31*e* which extends the inner face 31*a.*

The hedrons are supported and guided for rectilinear movement between an inner position as shown in FIG. 7 in which the volume of the working chamber is zero and an outer position as shown in FIG. 8 in which the working chamber has maximum volume. The means for supporting and guiding the hedrons in movement is shown in FIGS. 7 and 8 as comprising rockers 34 carried by rocker shafts 35 which are supported in the housing for rotation about axes perpendicular to the end plates 32. Each of the rockers has axially spaced arcuate surfaces 34*a* in position to engage the bearing surfaces 31*c* of the respective hedron. The faces 34*a* are concentric with the shaft 35. It will be seen that the arcuate faces of the rocker have a rolling engagement with the bearing surfaces 31*c* of the hedron to support the hedron and guide it in rectilinear motion as the rocker rocks about its axis.

Means is provided for coupling each rocker with the respective hedron to prevent slippage between the bearing surfaces of the hedron and arcuate faces of the rocker. The coupling means is shown in the drawings as comprising a hook portion 34*b* provided on each rocker between the arcuate faces 34*a* and in position to enter the corresponding notch 31*d* provided in the outer face of the hedron. A roller 36 is captured between the hook 34*b* of the rocker and the wall of the notch 31*d* of the hedron so as to provide a positive but low friction coupling between the hedron and the rocker. By virtue of this coupling, the rockers oscillate in synchronism with the rectilinear in and out movement of the hedrons.

Means is further provided for interconnecting the several rockers 34 so as to assure that all of the rockers and hence all of the hedrons move in synchronism with one another. As illustrated by way of example in FIG. 9, the synchronizing means comprises a synchronizer 37 in the form of an approximately triangular plate having a central collar 37*a* which provides a bearing surface for rotation of the synchronizer about a central circular boss 32*a* on one of the end plates 32. At its corners the synchronizer 37 is provided with slots 37*b* to receive pins 38 on arms 39 projecting radially from the rocker shafts 35. The slots 37*b* have parallel sides and are of sufficient depth to permit movement of the pins 38 radially of the synchronizer. As the hedrons move in and out between the positions shown in FIGS. 7 and 8, the rockers 34 oscillate about the axes of the rocker shafts 35 to which they are fixed. The oscillatory movement of the rockers is transmitted through the rocker shafts 35, arms 39 and pins 38 to the synchronizer 37 to cause it to oscillate about the central axis of the circular boss 32*a* of the end plate 32. By reason of the interconnection provided by the synchronizer, all of the rockers and hence all of the hedrons must move in synchronism with one another.

Means is also provided for coupling the synchronizer 37 with a power output shaft. As illustrated in FIG. 9 the synchronizer is provided with a radially projecting arm 40 which is fixed with respect to the synchronizer and moves with it. A slot 40*a* in the arm 40 receives a crankpin 41 carried by a crank arm 42 on a crank 43. The crankpin 41 is surrounded by a antifriction bearing 41*a* which is slidable in the slot 40*a* of the arm 40. Static and dynamic balance is provided by a counterweight 44 on the opposite side of the crank shaft from the crankpin 41. With the construction shown in FIG. 9 the crank 42 converts oscillatory motion of the synchronizer 37 into rotation of the crankshaft 43. The mechanism shown in FIG. 9 is housed in a crankcase 33*a* which forms a part of the housing 33 (FIGS. 7 and 8) but is sealed from the compartment containing the hedrons and rockers so that lubricant in the crankcase is kept out of the other compartments. A crankcase cover (not shown) is secured to the crankcase by a plurality of bolts passing through holes 45 provided in a peripheral portion of the crankcase.

Figure 10:
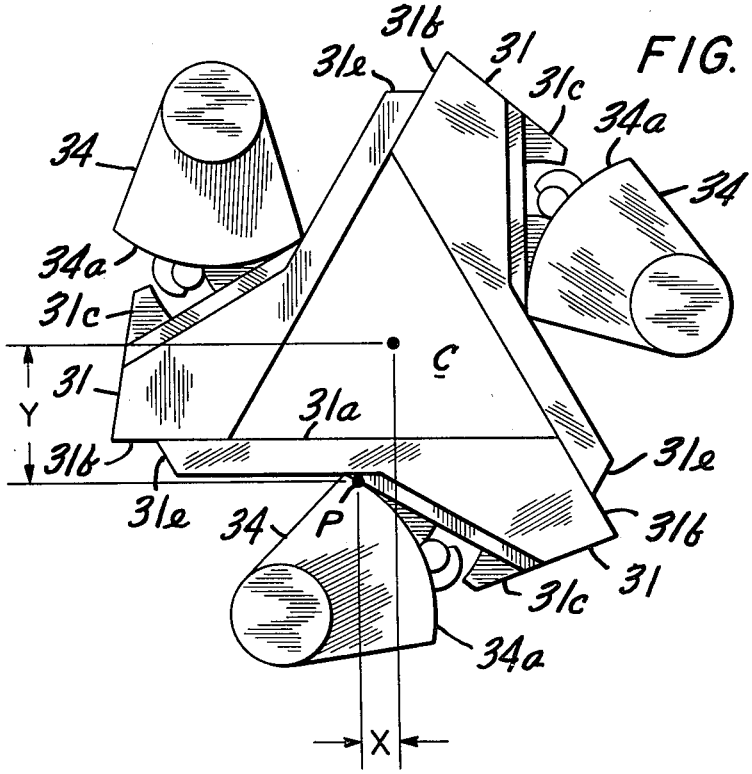
FIG. 10 is a schematic view of the three hedrons and support means of the embodiment of FIGS. 7 and 8 illustrating the self sealing characteristics of the chamber.

With the geometry of the parts shown in FIGS. 7 and 8, the hedrons have self sealing characteristic relative to one another as is illustrated in FIG. 10. With reference to the lower hedron shown in FIG. 10, it will be seen that the rocker face 34*a* of the rocker 34 engages the bearing surface 31*c* of the hedron at a point P which is to the left of the center of that portion of the inner face 31*a* of the hedron exposed in the chamber C. Hence, pressure of fluid in the chamber C acting on the inner face 31*a* of the hedron tends to rotate the hedron in a clockwise direction about the point P. The inner face of the extension 31*e* of the hedron is thereby pressed against the sealing face 31*b* of the adjacent hedron to provide a fluid tight seal. As each of the hedrons acts in like manner, a seal is provided between each hedron and the adjacent hedron. A seal between the end faces of the hedrons and the end plates may be provided by suitable sealing strips as described with reference to FIGS. 1 to 5 or by providing an end plate seal as described hereinafter.

Assuming that the engine illustrated in FIGS. 7 and 8 is to be operated as a four stroke cycle internal combustion engine, suitable provision is made for supplying fuel and exhausting the combustion products. As illustrated in FIG. 8, at least one of the end plates 32 is provided with a combustion chamber 46 of limited volume communicating with the central portion of the working chamber C defined by the hedrons. An intake valve 47 admits fuel air mixture to the combustion chamber while an exhaust valve 48 provides for the exhaust of combustion products. The valves are shown as being of the poppet type and are actuated in proper time relation with rotation of the crankshaft by suitable valve operating mechanism (not shown) as is well known in the art. A spark plug 49 having its tip in the combustion chamber provides for ignition of the fuel air mixture at the proper time. Alternatively, the intake valve 47 may admit only air if a fuel injection nozzle is provided as in FIG. 2 for delivering fuel to the combustion chamber. In this event, the fuel may be ignited either by a spark plug or by the temperature of the compressed air as in a Diesel engine. With the construction illustrated in FIG. 8, ignition first occurs in the combustion chamber 46 and the flame front then spreads into the working chamber C as the hedrons move from the top dead center position shown in FIG. 2 toward the bottom dead center position shown in FIG. 8.

Figure 11:
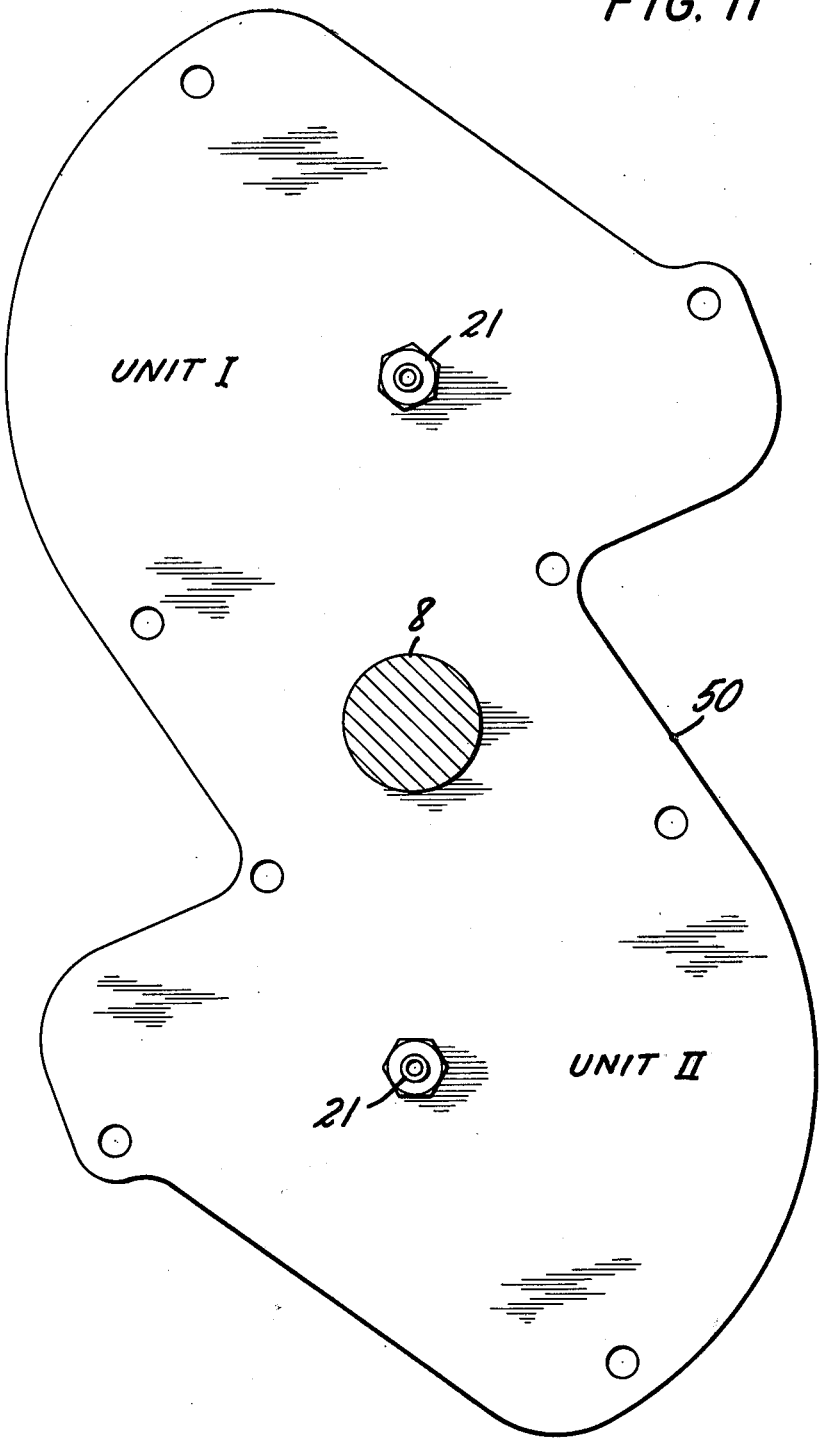
FIG. 11 is an end view showing the arrangement of a two chamber unit.

A plurality of units such as those shown in FIGS. 1 and 7 can be assembled to provide an engine of any desired capacity. For example, a plurality of units can be arranged axially along the same crankshaft. Alternatively, two units can be arranged on opposite sides of a crankshaft as illustrated in FIG. 11. Here, two units I and II are disposed symmetrically on opposite sides of a crankshaft 13 and are housed in a common housing 50. Assuming that the units are of the kind illustrated in FIGS. 1 to 4, the connecting rods 9 of the two units can work on the same crank of the crank rod 13 or may be provided with different cranks. If the two units work on the same crank, they will operate 180° out of phase relative to one another. If separate cranks are provided on the crankshaft, any desired phase relation can be selected. It will be further understood that any desired number of dual units such as that illustrated in FIG. 11 can be arranged axially along the crankshaft to provide an engine of any desired power.

Compression sealing is often considered to be the most critical problem which must be overcome in the development of both internal and external combustion engines. The engine of the present invention provides favorable possibilities for sealing. Specifically, all compression-sealed surfaces are flat and component motions are rectilinear so that there are no centrifugal forces. While several sealing grid arrangements are possible with the engine of the present invention, the arrangement illustrated in FIGS. 12 and 13 is presently preferred.

Except for the sealing arrangement, it will be seen that the engine shown in FIG. 12 is the same as that of FIG. 2. The gap between adjacent hedrons is sealed by multiple tip seals. Thus, as illustrated in FIG. 12, there are two parallel sealing strips 51 and 52 which extend from end to end of the hedron and are like the sealing strips 22 described with reference to FIG. 2. The gaps between the ends of the hedrons and the end plates are sealed by means of one or two end plate seals 53. When there are three hedrons as shown in FIG. 12, the end plate seal comprises a triangular body portion with projecting arms 53*a* at the corners of the triangle. The end plate seal fits snugly but slidably into a matching recess in the inner face of the end plate. A spring (not shown) acting between the end plate and a collar 53*b* on the end plate seal presses the latter against the end faces of the hedrons. As seen from FIG. 12, the body portion of the end plate seal has the same shape as the working chamber defined by the hedrons and is of a size to uncover the exhaust ports 19 when the hedrons are in maximum volume condition. In this condition, the end plate seal is supported by the projecting arms 53*a* which bridge the gaps between adjacent hedrons. The end plate seals 53 like the tip seals 51 and 52 are preferably of self lubricating material or other material having a low coefficient of friction so that they can operate "dry" and hence require no lubrication. While in the present description reference is sometimes made to the hedrons contacting or engaging one another or the end plates, it will be understood that where seals are provided, the actual contact or engagement is only with the seals. An end plate seal 53 has a central opening 53*c* for a fuel injector 21 and for pressure compensation so that a positive chamber pressure acts to force the seal against the end faces of the hedrons, in the same manner as that which occurs with conventional piston rings.

Expansible chambers in accordance with the present invention are applicable not only to internal combustion engines but also to external combustion engines, pumps and compressors. Of particular interest is their application to an external combustion engine operating on the Stirling cycle as illustrated in FIGS. 14 to 18. An advantage of the Stirling engine is that since the combustion is external, it can be controlled so as to obtain high efficiency and produce little or no pollution. Further advantages are that it can use any fuel and is exceptionally quiet in operation.

Figure 14:
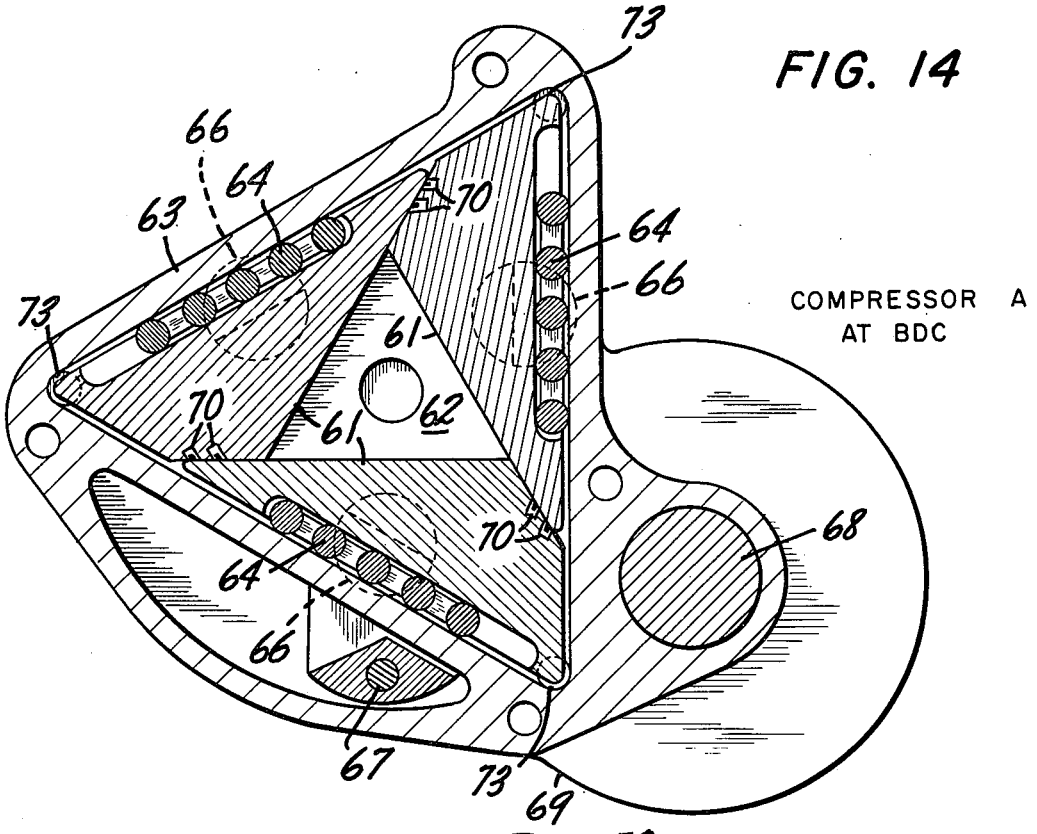
FIGS. 14 and 15 are respectively midplane sections of compressor unit and an expander unit of an external combustion engine operating on the Stirling cycle.
Figure 15:
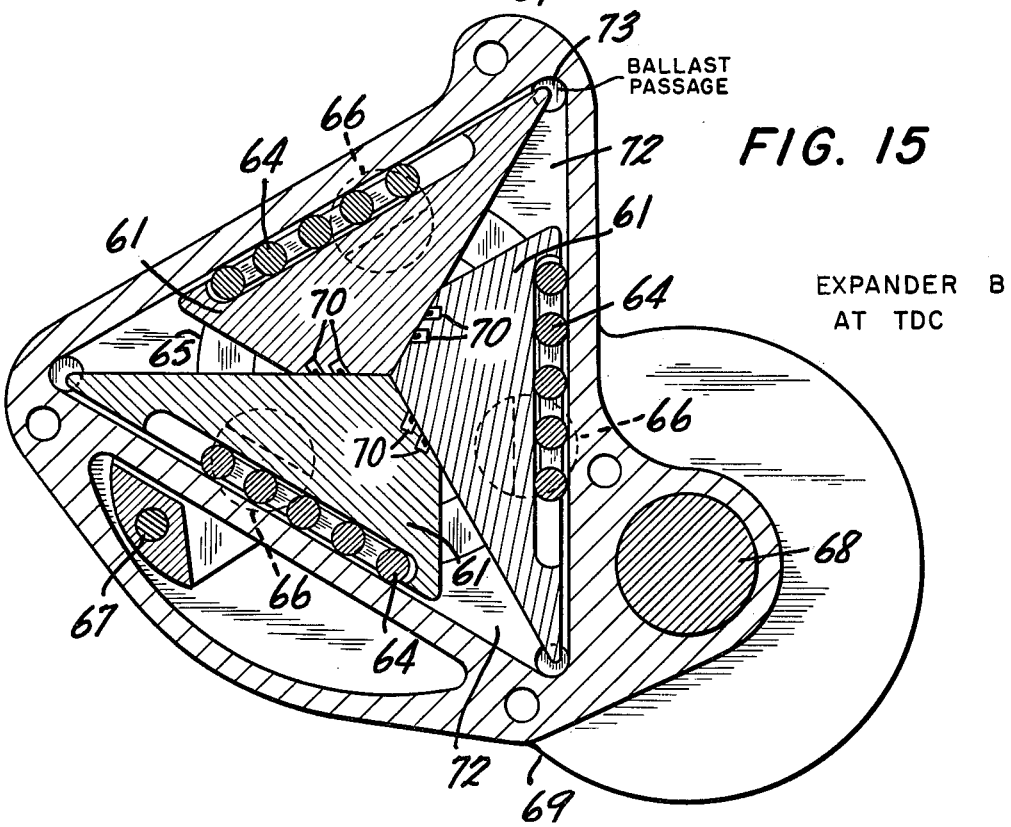
Figure 16:
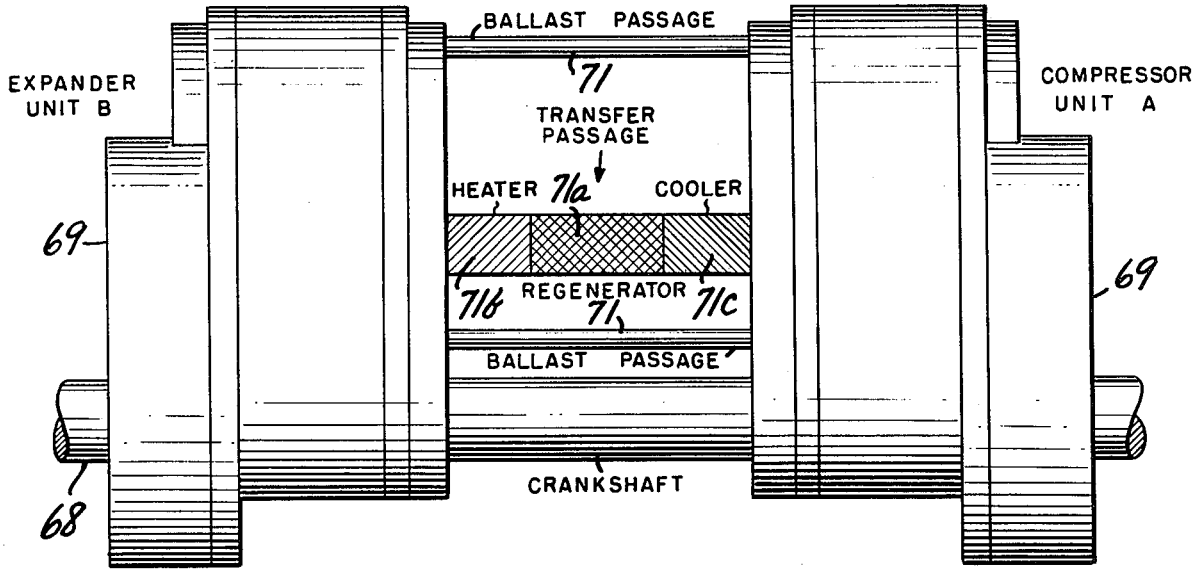
FIG. 16 is a diagram illustrating schematically the connections between the compressor unit and expander unit of a Stirling engine.

As illustrated in the drawings, a Stirling engine comprises two expansible chambers, namely a compressor as shown in FIG. 14 and an expander as shown in FIG. 15. The two units are mechanically interconnected so as to operate in synchronism with one another, for example by being on a common crankshaft as illustrated in FIG. 16 and the chambers communicate with one another through a transfer passage. The compressor A and expander B shown in FIGS. 14 and 15 are of like construction. Moreover, it will be seen that the construction is very similar to that illustrated in FIGS. 1 and 2. Each of the units is shown as comprising three hedrons 61 disposed between two end plates 62. The hedrons are enclosed in a housing 63 and provided with roller bearings 64 which support and guide the hedrons for rectilinear movement between the positions shown in FIGS. 14 and 15 respectively. As described in connection with FIGS. 1 to 6B, movement of the hedrons is synchronized by the interengagement of synchronizing rings 65 with hedron pins 66. Moreover, the two synchronizing rings 65 are interconnected by means of a tie rod 67 all as previously described. Moreover, the synchronizing rings are connected with a crankshaft 68 by a connecting rod and crank arrangement as illustrated in FIG. 3. The crank mechanism is enclosed in a crankcase 69. A seal is provided between adjacent hedrons by sealing strips 70 which correspond to the sealing strips illustrated in FIG. 12. Moreover, a seal is provided between the end faces of the hedrons and the end plates for example by sealing strips received in matching recesses as described with reference to FIGS. 5A and 5B or by end seals as illustrated in FIGS. 12 and 13. However, in the latter case the end seals can be larger as there are no exhaust ports which they are required to clear. Thus, the synchronizer ring can be extended inwardly, and the end seal or seals can be incorporated into the synchronizer.

The expansible chambers of the compressor A and the expander B communicate with one another through a transfer passage 71 which opens centrally in the chambers. The transfer passage includes a regenerator section 71*a* which can be regarded as a thermodynamic sponge alternately accepting and releasing heat. For example, it may contain a matrix of finely divided metal wires or strips. In accordance with the ideal Stirling cycle, the compressor chamber is cooled while the expander chamber is heated. However, for convenience of construction the cooling means and heating means may be embodied in sections of the transfer passage. Thus, as illustrated schematically in FIG. 16, a section 71*b* of the transfer passage adjacent the expander unit B comprises a heat exchanger in which the working fluid is heated by external combustion of the fuel or by any other heat source. A section 71*c* of the transfer passage adjacent the compressor unit A is provided with means for cooling the working fluid. For example, it may be a heat exchanger connected with a suitable radiator like the radiator of an internal combustion engine.

Figure 17:
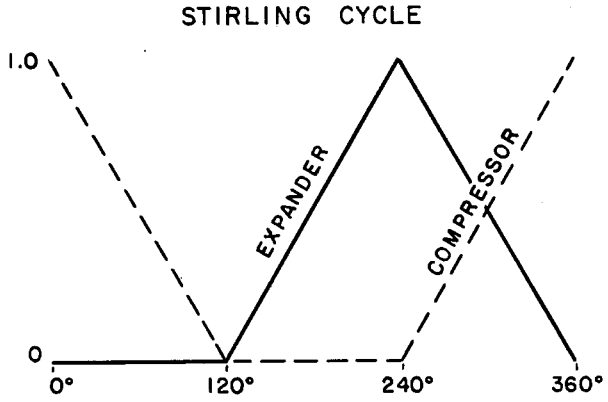
FIG. 17 is a graph illustrating the phase relationship between the compressor unit and expander unit.
Figure 18:
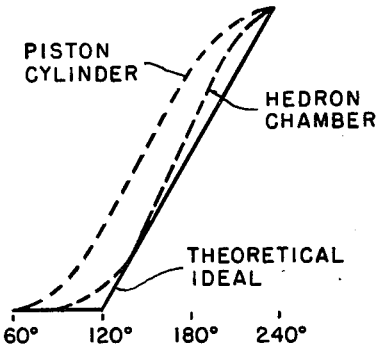
FIG. 18 is a graph comparing an actual with an ideal expansion curve.

The phase relationship of the two units and operation of the engine are illustrated graphically in FIG. 17, the horizontal axis represents crank angle of the engine while the vertical axis represents volume of the chambers. The broken line represents the compressor while the solid line represents the expander. Starting with the compressor at maximum value and the expander at zero volume as illustrated respectively in FIGS. 14 and 15, the volume of the compressor is reduced from maximum to zero during 120° of crankshaft rotation. By reason of the dwell at minimum volume provided by the geometry of the system, the volume of the expander remains approximately at zero. The heat produced by compression of the working fluid is partially extracted by the cooler 71*c*. As the working fluid passes through the porous regeneratore 71*a* and into the expansion space, it absorbs heat from the regenerator. During the next 120°of crankshaft rotation the working fluid is expanded in the working chamber of the expander which increases from zero to maximum volume. The compressor unit remains approximately at zero volume. Since the temperature of a gas falls as the gas expands, heat must be supplied to the working fluid by the heater 71*a* in order to maintain the temperature in the expansion space at a constant level. The heat is supplied by the external heat source, for example by combustion of fuel.

During the next 120° of crankshaft movement the volume of the working chamber of the expander decreases from maximum to zero while the volume of the working chamber of the compressor increases from zero to maximum in such manner that there is constant volume of the working fluid during transfer from the expander chamber to the compressor chamber. In going through the regenerator, the working fluid gives up heat which is stored in the matrix for use in the next cycle. The temperature of the working fluid falls from the high level to the low level resulting in a decrease of pressure to the original level.

FIG. 17 shows the theoretical ideal relationship between the expander and compressor. In practice, the ideal straight line curves are not achieved. One curve labeled "piston-cylinder" represents the crankshaft angle/volume relationship of a chamber defined by a piston reciprocating in a cylinder while another curve labeled "hydron chamber" represents the crankshaft angle/working chamber volume relationship on a chamber defined by hydrons in accordance with the present invention. It will be seen that the latter more closely approaches the ideal curve. Hence, a hydron engine in accordance with the present invention is more adaptable to operation on the Stirling cycle than a piston-cylinder engine. Moreover, as pointed out above the engine in accordance with the present invention has particularly good sealing characteristics. This is particularly important in a Stirling engine since the same working fluid is retained in the system.

As will be seen from a comparison of FIGS. 14 and 15 the volume of spaces 72 between the hydrons and the peripheral wall of the housing 63 varies as the hydrons move in and out. In order to compensate for pressure changes resulting from this change of volume, the spaces 72 of the compressor unit A are connected with corresponding spaces of the expander unit B by ballast passages 73.

From the foregoing description and the accompanying drawings, it will be seen that expansible chambers provided by the synchronized movement of hydrons in accordance with the present invention have wide applicability and important advantages over previously known expansible chamber devices. It will accordingly be understood that the invention is in no way limited to the particular embodiments which have been shown in the present application by way of example.

What I claim and desire to secure by Letters Patent is:

1. An expansible chamber device comprising a housing including two parallel end plates spaced from one another and a plurality of like hedrons disposed between said end plates, the number of said hedrons being not less than three and not more than six, each of said hedrons having opposite end faces engaging said end plates respectively, an inner face extending between said end faces and a sealing face extending between said end faces and disposed at an angle relative to said inner face, said sealing face of each hedron engaging the inner face of the next adjacent hedron to define a single working chamber bounded by said end plates and the inner faces of said hedrons, means supporting and guiding each of said hedrons for like translatory movement along a rectilinear path to vary the volume of said working chamber while maintaining the sealing faces of said hedrons in engagement with the inner faces of adjacent hedrons, means for synchronizing the movement of said hedrons, means connecting said synchronizing means with each of said hedrons, drive means, and power transmitting means connecting said synchronizing means with said drive means.

2. An expansible chamber device according to claim 1, in which said housing comprises a peripheral walls surrounding said hedrons to provide between said hedrons and said peripheral wall a precompression chamber, the volume of which varies inversely with that of said working chamber, said device having at least one intake passage leading to said precompression chamber and at least one transfer port connecting said precompression chamber with said working chamber when said precompression chamber is approximately at minimum volume and said working chamber is approximately at maximum volume.

3. An expansible chamber device according to claim 1, comprising fuel injecting means positioned in at least one of said end plates for injecting fuel into said working chamber.

4. An expansible chamber device according to claim 3, in which said hedrons are provided at the junction of said inner faces and sealing faces with recesses defining a combustion chamber when said hedrons are in inner positions.

5. An expansible chamber device according to claim 4, in which said combustion chamber defined by said recesses is at least approximately diconical.

6. An expansible chamber device according to claim 1, in which said hedrons move past the position of minimum volume of said working chamber, thereby increasing the dwell period at approximately minimum volume and providing a second expansion-compression cycle for each cycle of said drive means.

7. An expansible chamber device according to claim 1, in which said means for supporting and guiding each of said hedrons comprises a rectilinear support surface and antifriction bearing means between said support surface and an outer face of the respective hedron.

8. An expansible chamber device according to claim 1, in which said synchronizing means comprises an oscillatory member connected with each of the hedrons.

9. An expansible chamber device according to claim 8, in which said means connecting said oscillatory synchronizing member with said hedrons comprises a pin rotatable in a hole in each of said hedrons perpendicular to said end faces and having in at least one end a diametrically extending slot, and a boss on said oscillatory member received in said slot to provide a sliding pivotal connection.

10. An expansible chamber device according to claim 8, in which a said oscillatory synchronizing member is provided at each end of said hedrons, said synochronizing members being connected with one another to oscillate together.

11. An expansible chamber device according to claim 1, in which said means for supporting and guiding said hedrons in rectilinear movement comprises a rocker having an arcuate face engaging an outer face of each of said hedrons and interengaging means on each of said rockers and the respective hedron to cause said rocker and hedron to move together.

12. An expansible chamber device according to claim 11, in which said synchronizing means comprises an oscillatory member connected with each of the hedrons and in which means connecting said oscillatory synchronizing member with said hedrons comprises a rocker arm rotationally fixed with each of said rockers and means providing a sliding pivotal connection between each of said rocker arms and said oscillatory member.

13. An expansible chamber device according to claim 11, in which in each position of the hedrons said rockers bear on outer faces of the respective hedrons in locations to provide forces tending to rotate the hedrons in a direction to provide fluid tight sealing engagement between adjacent hedrons.

14. An expansible chamber device according to claim 1, in which one or more sealing members are provided within one or both of said end plates and engaging the respective hedron end faces to assure as seal between said hedrons and said hedrons and said end plates.

15. An expansible chamber device according to claim 1, comprising sealing strips set in end faces of each of said hedrons adjacent the inner face of the respective hedron and engaging the respective end plate to assure a seal between said hedrons and said end plates.

16. An expansible chamber device according to claim 1, further comprising means for introducing fuel into said working chamber and ignition means in at least one of said end plates for igniting said fuel.

17. An expansible chamber device according to claim 1, in which at least one of said end plates is provided with at least one poppet valve opening into said working chamber.

18. An expansible chamber device according to claim 1, in which at least one of said end plates is provided with a secondary chamber opening into said working chamber and at least one poppet valve opening into said secondary chamber.

19. An expansible chamber device according to claim 1, in which means providing a compression seal between said hedrons and an end plate comprises a seal having a plane sealing face which slidably engages the adjacent end faces of said hedrons, an opposite backup face which is sealed relative to the adjacent end plate, and at least one opening connecting said sealing face of the seal with said backup face to provide pressure compensation across said seal.

20. An expansible chamber device according to claim 1, in which said inner faces and said sealing faces of said hedrons extend rectilinearly between said end faces.

21. An expansible chamber device comprising a plurality of like units each of which is an expansible chamber device as claimed in claim 1, said units being assembled in fixed relation to one another, said units having a common drive means operatively connected with the synchronizing means of all of said units.

22. An expansible chamber device comprising a housing including two parallel end plates spaced from one another and three like hedrons disposed between said end plates, each of said hedrons having opposite end faces engaging said end plates respectively, an inner face extending rectilinearly between said end faces, a sealing face disposed at an angle of 120° to said inner face and an outer face disposed at an angle of 30° to said inner face, said sealing face of each hedron engaging the inner face of the next adjacent hedron to form a single working chamber bounded by said end plates and the inner faces of said hedrons, means engaging said outer faces of said hedrons to support and guide each of said hedrons for translatory movement along a rectilinear path to vary the volume of said working chamber while maintaining the sealing faces of said hedrons in engagement with the inner faces of adjacent hedrons, means for synchronizing the movement of said hedrons, said synchronizing means comprising a movable synchronizing member and means connecting said member with each of said hedrons, and drive means comprising a rotary member and means connecting said synchronizing member with said rotary member and converting movement of said synchronizing member into rotary movement of said rotary member.

23. An expansible chamber device according to claim 22, in which said housing comprises a peripheral wall surrounding said hedrons to provide between said hedrons and said wall a precompression chamber, the volume of which varies equally and oppositely with that of said working chamber, said device having at least one intake passage leading to said precompression chamber and at least one transfer portion connecting said precompression chamber with said working chamber when said precompression chamber is approximately at minimum volume and said working chamber is approximately at maximum volume.

24. An expansible chamber device according to claim 23, in which at least one end plate is provided with exhaust ports which are uncovered by said hedrons when said working chamber is approximately at maximum volume.

25. An expansible chamber device according to claim 23, comprising fuel injecting means in at least one of said end plates for injecting fuel into said working chamber when of approximately minimum volume.

26. An expansible chamber device according to claim 22, in which said hedrons are provided at the junction of said inner faces and sealing faces with recesses defining a combustion chamber when said hedrons are in inner positions.

27. An expansible chamber device according to claim 22, in which spaced parallel grooves are formed in the sealing face of each of said hedrons, said grooves extending between opposite end faces of the respective hedron and in which sealing strips set in said grooves engage the inner face of an adjacent hedron to form a compression seal between the hedrons.

28. An expansible chamber device according to claim 22, in which means providing a compression seal between said hedrons and an end plate comprises a triangular body with three projecting arms at the corners of the triangle, said end plate fitting into a matching recess in the end plate and slidably engaging end faces of said hedrons.

* * * * *